United States Patent [19]

Traylor

[11] Patent Number: 4,856,121

[45] Date of Patent: Aug. 15, 1989

[54] AIR GAP FAUCET

[76] Inventor: Paul L. Traylor, 16591 Milliken Ave., Irvine, Calif. 92714

[21] Appl. No.: 222,951

[22] Filed: Jul. 22, 1988

Related U.S. Application Data

[63] Continuation-in-part of Ser. No. 866,402, May 23, 1986, Pat. No. 4,771,485.

[51] Int. Cl.[4] ..... E03C 1/00

[52] U.S. Cl. ..... 4/191; 137/216; 137/801

[58] Field of Search ..... 4/191, 192, 195; 137/216, 216.1, 616.3, 359, 801, 454.2, 554, 552.7

[56] References Cited

U.S. PATENT DOCUMENTS

| | | | |
|---|---|---|---|
| 1,135,917 | 4/1915 | Partington | 239/30 |
| 2,200,503 | 5/1940 | Judell et al. | 239/588 |
| 2,344,150 | 3/1944 | Judell | 239/588 |
| 2,790,632 | 4/1957 | Mellette | 137/801 |
| 3,155,106 | 11/1964 | Baron | 137/216 |
| 3,183,923 | 5/1965 | Henrikson | 137/216 |
| 3,424,336 | 1/1969 | Perez et al. | 206/459 |
| 3,455,324 | 7/1969 | Bieri et al. . | |
| 3,512,545 | 5/1970 | Weaver | 137/216 |
| 3,620,241 | 11/1971 | Brown | 137/216 |
| 3,642,176 | 2/1972 | Dreibelbis . | |
| 3,669,141 | 6/1972 | Schmitt | 137/359 |
| 3,680,780 | 8/1972 | Arbon | 239/30 |
| 3,706,321 | 12/1972 | Vicari | 137/554 |
| 3,766,882 | 10/1973 | Babbitt, III | 206/534 |
| 3,967,638 | 7/1976 | Tondreau | 137/216 |
| 4,005,804 | 2/1977 | Dreibelbis . | |
| 4,134,419 | 1/1979 | Richetti | 137/216 |
| 4,186,761 | 2/1980 | Guarnieri | 4/192 |
| 4,210,533 | 7/1980 | Astl | 137/216 |
| 4,454,891 | 6/1984 | Dreibelbis et al. | 137/216 |
| 4,457,342 | 7/1984 | Moen | 137/801 |

FOREIGN PATENT DOCUMENTS

| | | | |
|---|---|---|---|
| 512257 | 1/1955 | Italy | 137/801 |

*Primary Examiner*—Linda J. Sholl

*Attorney, Agent, or Firm*—Fulwider, Patton, Lee & Utecht

[57] ABSTRACT

An air gap faucet for attachment to sink structure. The faucet includes a housing which encloses upper and lower mounts which together define an integral air gap. The upper mount carries a valve mechanism operative to dispense potable water. The potable water and associated conduits are slidably disposed through the lower mount so that the upper mount can be raised above the lower mount and faucet housing for easy inspection of the valve mechanism and the air gap components.

16 Claims, 3 Drawing Sheets

AIR GAP FAUCET

CROSS REFERENCE TO RELATED APPLICATIONS

This application is a continuation-in-part of my copending parent patent application Ser. No. 866,402, filed May 23, 1986, now U.S. Pat. No. 4,771,485. The present application discloses further embodiments which are more quickly and easily attached to a mounting structure such as a sink structure, comprised of fewer components for ease of manufacture and installation, and characterized by additional features of value to both the installer and user.

BACKGROUND OF THE INVENTION

1. Field of the Invention

The present invention relates to an air gap faucet for attachment to mounting structure, and more particularly to an air gap faucet having a valve body located within and separable from a faucet housing for inspection and maintenance of the valve body and related components without disconnection of associated water conduits.

2. Description of the Prior Art

Faucets of the type to which the present invention is directed are auxiliary faucets mountable to existing mounting or sink structure for association with a reverse osmosis or "RO" system. Such a system produces potable water which is carried to the faucet by a potable water conduit. Generally these RO systems also discharge waste water which is carried into the faucet by a waste water inlet conduit. The waste or reject water is typically rather salty, corrosive and is characterized by high total dissolved solids. This water passes through an air gap which is integral with the faucet, and then passes to a waste water outlet conduit that is connected to a sewer line or the like. The air gap prevents backsyphoning of sewage or tainted water into the RO system and is a plumbing code requirement. Plumbing codes usually require at least a one inch air gap, as well as a marking on the faucet designating the height or "critical level" (C/L). The C/L must be at least one inch above the faucet mounting base.

Most prior art auxiliary faucets of the RO type are not easily serviced and almost all require dismantling and separating from the sink structure. Further, their installation typically requires that a relatively large diameter opening b provided in the kitchen sink, in the order of one and a quarter inches to accept the mounting stud and the potable water and two waste water conduits. Providing such a large opening in a porcelain clad cast iron or stainless steel sink is time consuming, costly and potentially damaging to the sink.

The inability to easily service or replace elements of prior art RO air gap faucet fixtures is a particular problem. The conduits defining the air gap path almost always include a metal alloy which is susceptible to corrosion, as well as to clogging by mineral deposits or other foreign matter. Also, prior art faucets generally do not make allowance for the electrical contacts or circuits to be at a sufficiently high elevation so that they will not be exposed to potential flooding during times when the downstream plumbing lines become clogged. Also, these faucets generally do not provide a margin of safety for the air gap spacing during downstream flooding conditions.

Prior art faucets exhibiting the above shortcomings include U.S. Pat. No. 3,967,638, issued to Tomdreau; U.S. Pat. No. 4,454,891, issued to Dreibelbis et al; and U.S. Pat. No. 3,620,241, issued to Brown. The maintenance of these and similar faucets requires disassembly and separation from the sink structure. The structure of U.S. Pat. 4,134,419, issued to Richetti, and U.S. Pat. No. 4,516,753, issued to Thompson are also of interest in this regard.

SUMMARY OF THE INVENTION

According to the present invention, a faucet is provided which is easily attachable to the upper surface of a mounting structure such as a sink structure, often without any need for access to the underside of the sink structure except for a single nut or the like.

The faucet includes a conduit mounting sleeve or fastener mount which can easily be disposed through faucet openings as small as five eighths of an inch. The lower extremity of the fastener mount sleeve is preferably threaded to accept a bottom nut which bears against the underside of the sink structure and firmly secures the faucet in position.

The faucet includes a cylindrical faucet housing having a base engaged by a flange of the fastener mount to secure the housing to the upper surface of the sink structure. The housing encloses and supports a valve body which is connectable to the potable water source by a potable water conduit extending through the fastener mount. The valve body is separable from the housing without any need for disconnection of the fastener mount from the sink structure. This can be done by raising the valve body upwardly of the housing, which permits easy servicing of the valve body and related components.

The valve body mounts a typical dispensing spout for dispensing potable water from the RO system potable water conduit.

The valve body includes an air gap having a gooseneck upper portion connected to or comprising the inlet waste water conduit from the RO system. The air gap also includes a cup shape drain receiver supported upon the fastener mount flange within the faucet housing. The receiver is located in spaced relation below the discharge end of the gooseneck portion to receive RO reject or waste water. An outlet waste water conduit connected to the drain receiver carries off the waste water to a suitable sewer drain. Both waste water conduits are preferably made of plastic to reduce liming and clogging.

It is not likely to be necessary during normal service life, but the bottom nut can easily be unscrewed to enable the fastener mount to be moved axially upwardly of the sink opening. It is more likely that the conduits which are readily extendable will need to be raised to accommodate service or inspection. The fastener mount and conduits include depending portions which extend below the sink opening to permit this upward extension. The depending portions are freely slidable and have a length which approximates the height of the faucet housing so that the valve body can be pulled upwardly of the housing for inspection or maintenance.

Certain embodiments of the invention include structure to provide indicia useful to the householder in the maintenance of an RO system.

Other aspects and advantages of the present invention will become apparent from the following more detailed description taken in conjunction with the accompanying drawings.

DESCRIPTION OF THE PREFERRED EMBODIMENTS

Figure 1:
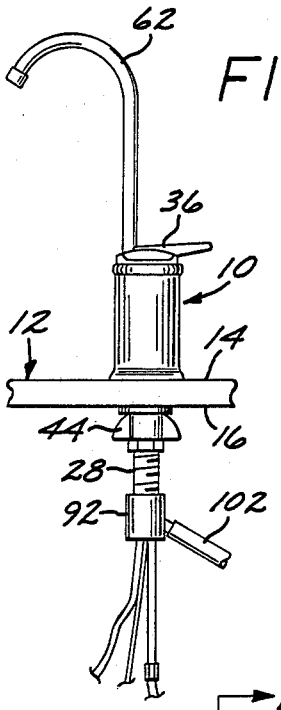
FIG. 1 is side elevational view of the present air gap faucet mounted to a sink structure, the faucet being illustrated in association with a potable water conduit a pair of waste water conduits, and electrical fittings.
Figure 2:
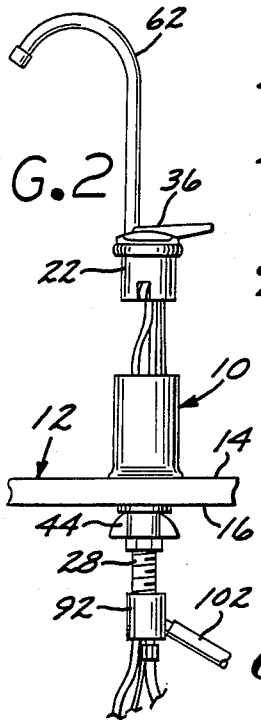
FIG. 2 is a view similar to FIG. 1, but illustrating the upper mount pulled upwardly of the faucet housing for inspection and maintenance of the associated components.
Figure 3:
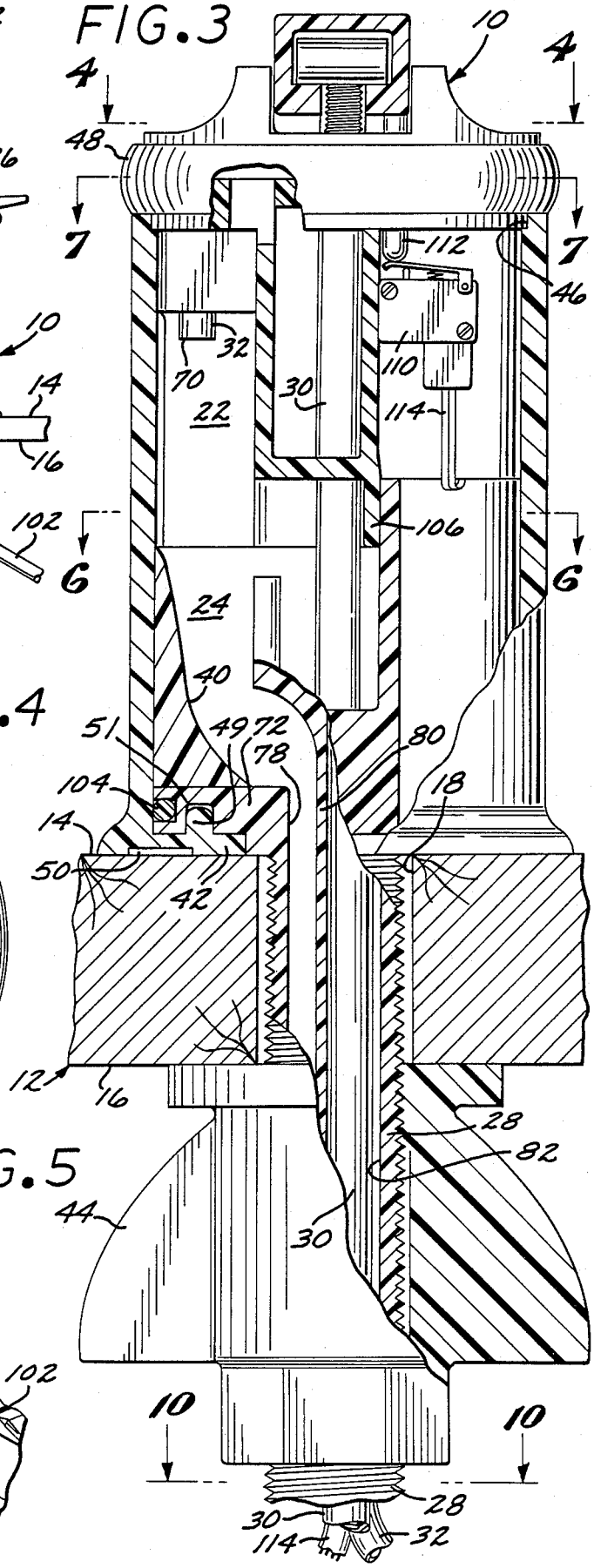
FIG. 3 is an enlarged side elevational view, partially cut away and partially in section, illustrating the installed faucet of FIG. 1.
Figure 4:
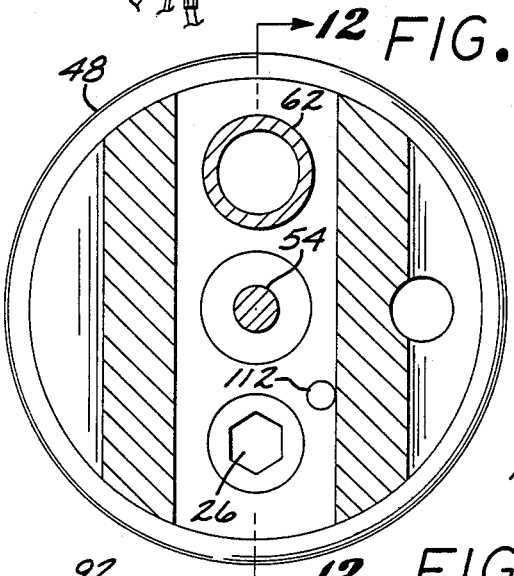
FIG. 4 is a view taken along the line 4—4 of FIG. 3.

Referring now to FIGS. 1-10, 12 and 13, there is illustrated a reverse osmosis faucet 10 according to the present invention. The faucet is shown in association with a counter or sink structure 12 which, as seen in FIG. 3, includes an upper surface 14, a lower surface 16, and a faucet opening 18.

The faucet 10 is adapted for mounting in association with faucet openings of various sizes, the faucet opening 18 being typical of relatively large openings in the order of 1 and ¼ inches provided in sinks. The faucet 10, as will be seen, is quickly mounted in position by hand turning a single fastener.

Figure 12:
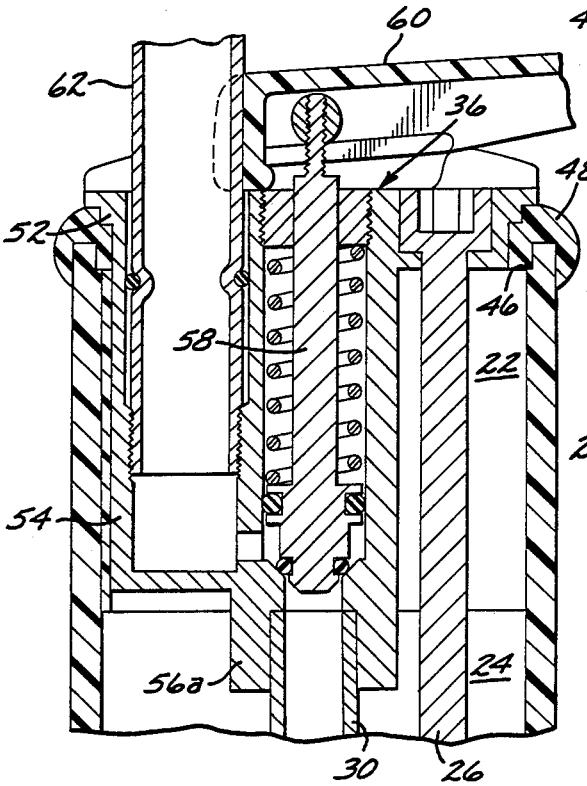
FIG. 12 is a view taken along the line 12—12 of FIG. 4.

The faucet 10 comprises, generally, an open ended, cylindrical faucet housing 20 which encloses an upper mount 22 and a lower mount 24. The mounts 22 and 24 may be held together by friction within the housing 20, but preferably they are positively clamped together by a fastener 26, as shown in FIG. 12. The lower mount includes an elongated, hollow and externally threaded fastener mount 28 through which is disposed a potable water conduit 30, a waste water inlet conduit 32 and, optionally, electrical leads 114. It also defines a waste water outlet passageway 78.

The potable water conduit 30, which comes from a conventional reverse osmosis or RO unit (not shown), is connected to the valve mechanism for dispensing potable water on demand. The waste water inlet conduit 32 extends through the fastener mount 28 and up into the upper mount 22, the conduit 32 including a downwardly directed discharge end 70 which is located above a waste water collection cup 40 to define the requisite air gap. As seen in FIG. 3, the cup rests upon a radially directed flange 72 of the lower mount 24. It also rests against the inner surface of housing 20 to substantially prevent water leakage at their interface, as will be seen.

The fastener mount flange 72 rests upon a base 42 of the housing, and a suitable fastener such as a bottom nut 44 is disposed upon the lower extremity of the threaded exterior of the fastener mount to clamp the faucet housing 20 onto the sink structure 12.

The foregoing comprises the major components of the present faucet 10. The following description sets forth the details respecting the construction and arrangement of these components.

The upper end of the faucet housing 20 is counterbored to provide an upper seat 46 which closely receives a circular trim ring 48 integral with the upper end of the up per mount 22. The base 42 of the faucet housing is in the form of a radially inwardly directed flange having an underside which includes a circumferential groove 50 to receive plumbers putty or the like. This insures a good seat with the sink upper surface 14. The base 42 also includes an upwardly directed boss 49 which fits within a downwardly opening recess or seat 51. This keys the relative positions of the faucet housing and the lower mount so that they can only be assembled in the illustrated positions. As will be seen, this is also true with respect to the valve housing and upper mount.

Figure 14:
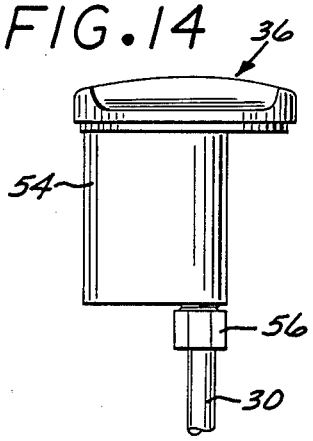
FIG. 14 is a side elevational view, on a reduced scale, showing a compression fitting connection of the potable water conduit to the valve body in the upper mount.

As seen in FIG. 12, the trim ring 48 includes an annular seat which supports a circular flange 52 of the valve mechanism 36. The valve mechanism includes a downwardly extending body 54 to which the potable water conduit 30 is attached, either by a soldered connection, as seen at 56*a* in FIG. 12, or by a compression fitting or nut 56, as seen in FIG. 14. The lower end of the valve body 54 would be recessed or externally threaded, depending upon the nature of the connection to the potable water conduit and the material of which the conduit is made.

The valve mechanism forms no part of the present invention, being conventional in construction. It comprises, generally, as seen in FIG. 12, a valve 58 operated by a valve handle 60 to admit water from the potable water conduit 30 to a discharge spout 62.

The usual commercially available valve mechanism is made of metal which is plated. However, the major components of the remainder of the present faucet are preferably made of molded plastic. This reduces corrosion, and especially enables integral formation in the faucet of the spaces necessary for receiving certain faucet components. Moreover, and such material is not subject to corrosion. Of course, items such as the faucet housing 20 could be made of chrome plated metal if a shiny metallic appearance is desired, but plastic is preferred because it can be made in any desired color to match a kitchen decor.

The valve body 54 is firmly secured to the upper mount 22 and it in is turn firmly secured to the lower mount 24 by the fastener 26, as best seen in FIG. 12. The head of the fastener is seated within a counterbore in the valve body, while the lower end of the fastener is threaded into the lower portion of the lower mount 24.

Figure 7:
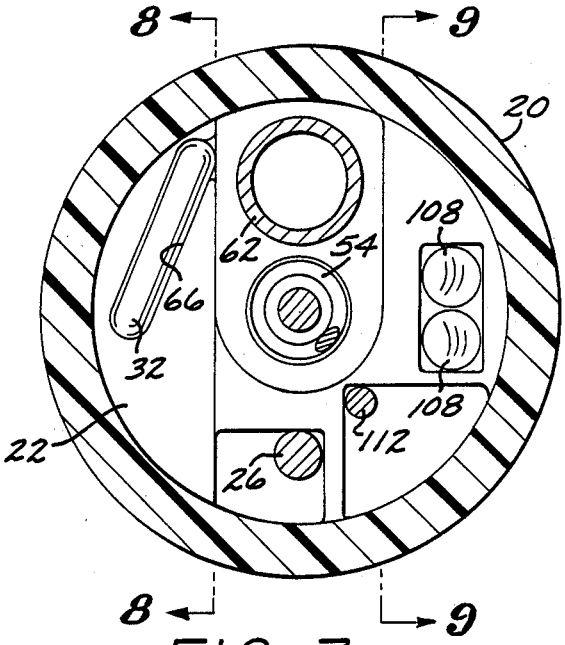
FIG. 7 is a view taken along the line 7—7 of FIG. 3.
Figure 8:
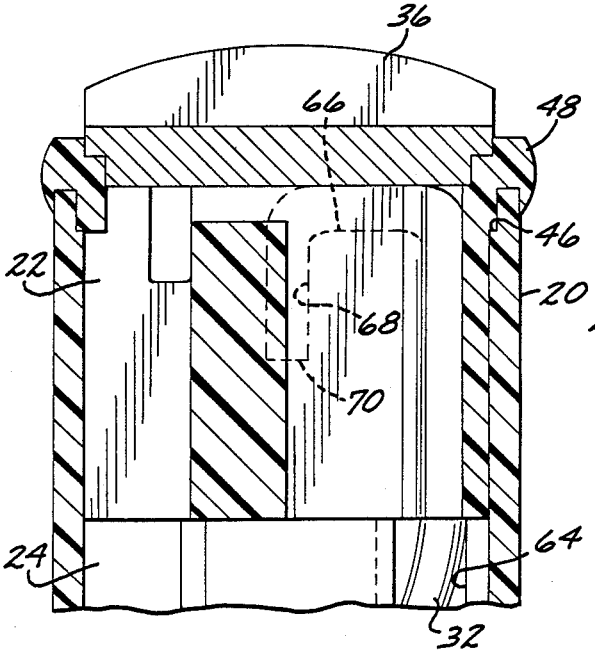
FIG. 8 is a view taken along the line 8—8 of FIG. 7.

The upper mount 22 includes an integral or molded-in passage having a vertical portion 64, as best seen in FIG. 8, a horizontal portion 66, as seen in FIG. 7 and a downwardly directed portion 68, as seen in FIG. 8.

The waste water inlet conduit 32 is made of flexible plastic tubing and is slidably disposed through the passage portions 64, 66 and 68 so that it forms naturally into a gooseneck having the downwardly directed discharge end 70, as also seen in FIG. 3. Waste water coming from the reverse osmosis system thus passes upwardly through the gooseneck and out of the end 70. The end 70 defines the upper terminus of the integral air gap of the faucet 10.

Figure 6:
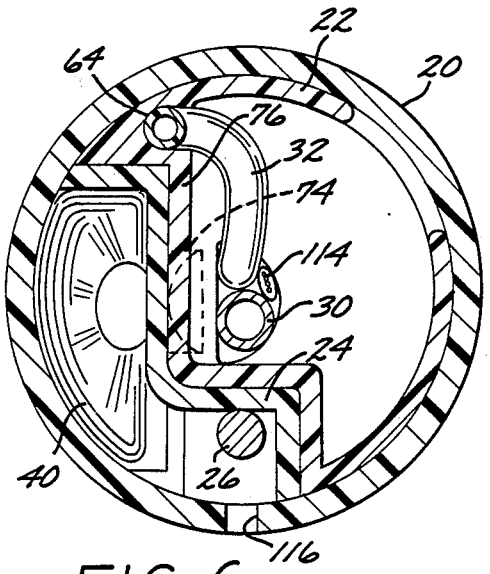
FIG. 6 is a view taken along the line 6—6 of FIG. 3.
Figure 13:
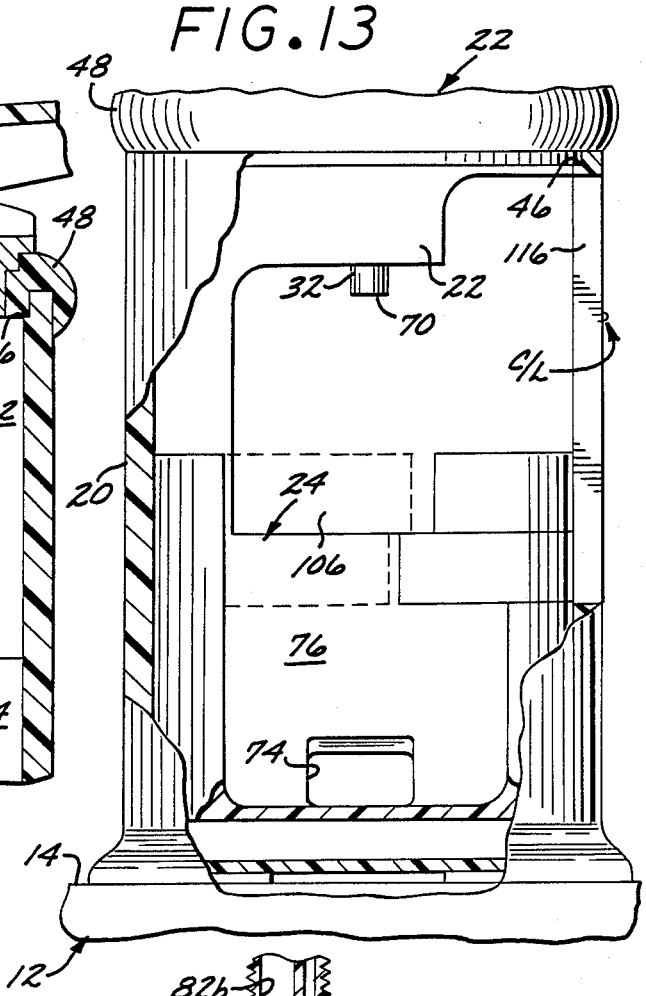
FIG. 13 is a side elevational view of the faucet housing, with portions cut away to show components of the air gap.

The waste water discharged from the end 70 falls into the drain receiver or collection cup 40 which is fitted closely within the housing 20, as described earlier. More particularly, the cup 40 fits closely within the lower mount recess and is characterized by an exterior surface which fits in close relation to the interior surface of the adjacent faucet housing 20. It is further characterized by a smoothly sloping interior surface which narrows to a minimum diameter at its base, at which point it empties into a relatively large opening 74, as seen in FIG. 13. As seen in FIGS. 6 and 13, the opening 74 extends through an integral wall 76 of the lower mount, the opening 74 being in communication with a vertically extending cup drain space 78 forming a part of the interior of the cylindrical fastener mount 28. The fastener mount 28 includes an integral vertically extending wall or web 80 which divides the interior of the mount into the cup drain space 78 and also an adjacent conduit space 82, as best seen in FIG. 10.

The cup 40 can be either press fitted into position for easy removal and cleaning, or it can be adhesively secured to the upper surface of the fastener mount 28. The upper extremity of cup 40 forms the lower terminus of the integral air gap of the faucet 10.

Figure 10:
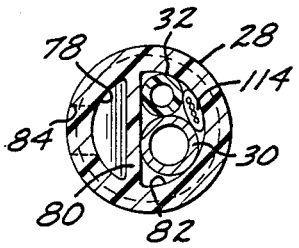
FIG. 10 is a view taken along the line 10—10 of FIG.

As seen in FIG. 10, the potable water conduit 30 and the waste water inlet conduit 32 pass through the conduit space 82, isolated from the relatively corrosive salty water passing through the cup drain space 78.

Figure 15:
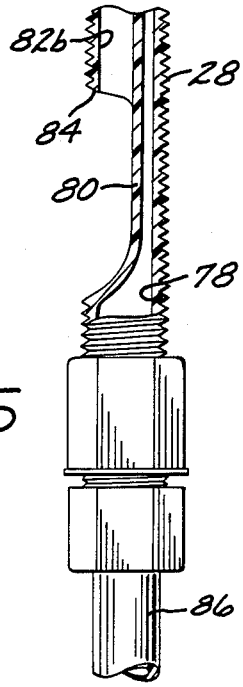
FIG. 15 is an enlarged detail view of the lower extremity of the fastener mount, with portions cut away to illustrate the integral cup drain space and conduit space.

As seen in FIG. 15, in a modified embodiment, compared to that of FIG. 3, the lower extremity of the fastener mount 28 can be cut away at 84 to provide access to a modified conduit space 82*b*. This enables the potable water conduit 30 and waste water inlet conduit 32 to be passed laterally into and then upwardly through the conduit space 82*b*. FIG. 15 also illustrates how the lower end of the fastener mount 28 can be attached by suitable conventional connectors to a length of flexible tubing 86 which can be connected to a sewer line (not shown) to carry away the waste water.

Figure 5:
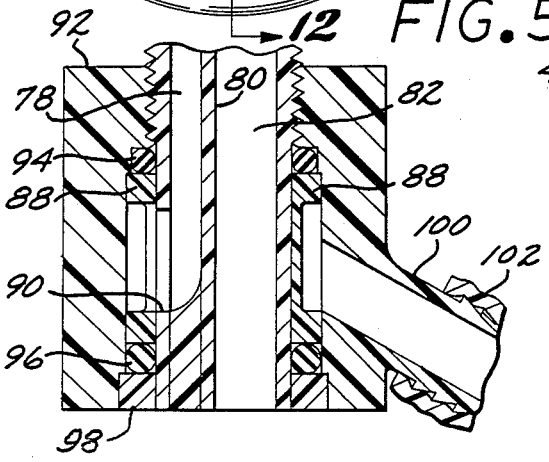
FIG. 5 is an enlarged detail view of the waste water outlet discharge elbow.

FIG. 5 illustrates an arrangement in which a vertically slotted cylindrical cage 88 is slidably fitted over an unthreaded lower extremity of the fastener mount 28, with one of the slots of the cage always being in communication with a slot 90 provided in the fastener mount so as to receive water flow from the cup drain space 78. A nut 92 is threaded onto the threaded portion of the fastener mount and includes annular recesses to receive the cage 88 and also to receive a pair of O-ring seals 94 and 96 above and below the cage. The lower O-ring 96 is held in position by a retainer ring 98 which is secured in position by a suitable adhesive.

The nut 92 includes a downwardly sloping conduit 100 communicating with the cage slots and the cup drain space 78 to carry away waste water. The waste water is emptied into a suitable length of tubing 102 which extends to a sewer line or the like. It is noted that in this embodiment the conduit space 82 is downwardly open so that the potable water conduit 30 and waste water inlet conduit 32 can be disposed vertically upwardly into the conduit space 82, rather than laterally, as in the embodiment of FIG. 15. This arrangement would be used if conduits of rigid material were involved.

The threaded lower portion of the fastener mount 28 extends through a central opening in the faucet housing base 42, and its flanged upper portion includes a circumferential recess which receives a sealing O-ring 104, as seen in FIG. 3. This provides a water tight seal between the fastener mount and the adjacent inner wall of the faucet housing 20.

Figure 16:
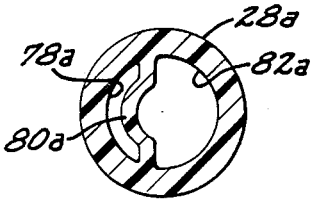
FIG. 16 is a view similar to FIG. 10, but illustrating an embodiment in which the cup drain space and conduit space are differently configured.

The air gap which is integral with the faucet 10 is thus associated with a generous size opening 74 and an equally generous size cup drain space 78 so that there is little resistance to drainage of waste water from the faucet. Such generous flow passages tend to reduce the sometimes annoying sound of dripping water which is characteristic of the usual constantly operating RO systems installed in households. In addition, the large entry opening 74 tends to reduce air entrapment during normal flow. This results in less noise in the air gap area and consequently a quieter operating faucet. If such a generous space is deemed not necessary for a particular application, and more space is desired for the conduits, the spaces 78 and 82 may be modified as shown at 78*a* and 82*a* in FIG. 16.

Figure 11:
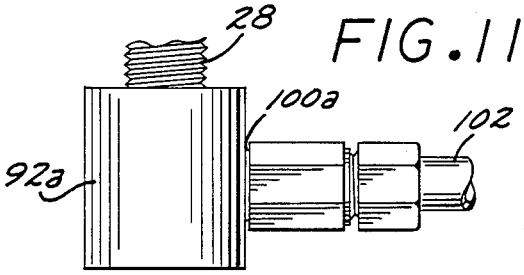
FIG. 11 is an enlarged detail view of another form of waste water discharge outlet.

FIG. 11 shows a variation on the arrangement of FIG. 5, the nut 92 being replaced by a nut 92*a* which is characterized by a right angularly disposed conduit 100*a* to which conventional compression fittings are attached to connect the nut 92*a* with the drain tubing 102.

Although the upper and lower mounts may be keyed in any suitable fashion so that they mate in a single predetermined relationship, the proper indexing of the upper mount relative to the lower mount is provided by a depending skirt 106 integral with the upper mount, as seen in FIG. 3. It is closely slidably received by the upper walls defining the recess within which the drain cup 40 is received.

Figure 9:
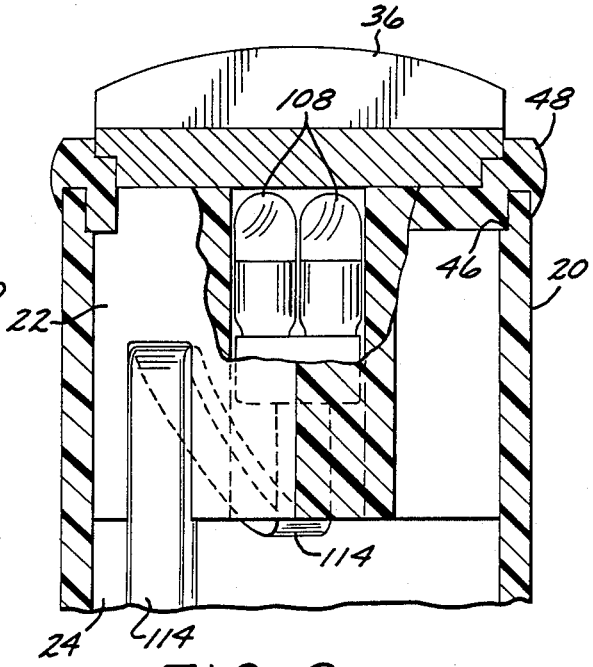
FIG. 9 is a view taken along the line 9—9 of FIG. 7.

By utilizing plastic to form the upper and lower mounts, it is possible to mold in recesses, as seen in FIGS. 3, 7 and 9 to receive a pair of indicator lights 108 and a switch 110. The switch is operated by a plunger 112 under and actuated by water dispensing handle 60. Its operation closes a circuit which includes the lights 108 and electrical leads 114 extending to a sensing system (not shown) associated with the RO system. The leads 114 are disposed through suitable passages molded in the mounts 22 and 24, and extend downwardly through the conduit space 82.

The particular sensing system is not a part of the present invention. In general, such systems sample potable RO water as it flows from the RO unit, and determines the total dissolved solids (TDS). If such solids are excessive, warranting a change in the filter, etc., this causes one of the lights 108 to come on when the switch 110 is operated. This would preferably be a red light. If the water quality is satisfactory, the other, usually green, light would come on.

The faucet 10 is quickly installed to the sink structure 12 by disposing the fastener mount 28 through the faucet opening 18 and tightening the bottom nut 44 grasping its radially extending webs. This causes the upper portion of the fastener mount to pull down upon the base of the faucet housing 20, securely holding it in position upon the upper surface of the sink structure 12. However, the upper mount 22 and its associated valve mechanism are quickly and easily upwardly separable from both the lower mount and the faucet housing simply by loosening the fastener 26. The upper mount 22 can then be grasped to pull it upwardly to expose the valve mechanism and the waste water inlet conduit to inspection. To enable extension of the upper mount far enough above the faucet housing to enable such inspection, the portion of the conduits 30 and 32 extending below the fastener mount 28 are made sufficiently long to define what might be termed extension portions which are upwardly slidable within the conduit space 82, as seen in FIG. 2. The upper mount 22 is quickly replaced by reversing this procedure.

Air for the air gap space is provided by forming a suitably sized vertical slot 116 through the wall of the faucet housing 20, as seen in FIG. 13. The faucet "C/L" designator mark is displayed alongside this slot 116.

In operation, the air gap provided by the faucet is more than ample to satisfy all plumbing code requirements. The size of the passages for the waste water is sufficiently generous to reduce faucet noises associated with an RO system, and also to allow relatively large amounts of waste water to be carried away. This is particularly advantageous in those RO systems characterized by periodic high rates of flow for flushing out the system.

From the foregoing it will be apparent that the present faucet 10 is uniquely adapted for easy installation and maintenance and provides an extremely reliable and easily checked air gap structure. The valve mechanism can be operated in its extended or elevated position for inspection during operation. Similarly, the waste water discharge and subsequent outflow can be observed while extended, unlike fixtures of the prior art.

Various modifications and changes may be made with regard to the foregoing detailed description without departing from the spirit of the invention.

I claim:

1. In a faucet installation associated with a mounting structure having a faucet opening, and in which the installation includes a faucet connected to a potable water conduit for dispensing potable water on demand, and further connected to waste water inlet and outlet conduits, an improved faucet having an integral air gap between the waste water inlet and outlet conduits and comprising;

a faucet housing which includes an upper seat and a base engaged upon the upper side of the mounting structure, the base having an opening for alignment with the faucet opening;

a valve mechanism coupled to the potable water conduit and operative to dispense potable water;

an upper mount located within the faucet housing and carried by the upper seat, the upper mount mounting fastening means and receiving the valve mechanism, and further receiving the upper extremity of the waste water inlet conduit to define with the waste water conduit the upper portion of the air gap;

a lower mount located within the faucet housing below the upper mount, the lower mount including a waste water collection cup defining the lower portion of the air gap, the cup including a drain outlet, the lower mount further including an elongated, hollow and externally threaded fastener mount extending from the interior of the faucet housing through the central opening, the fastener mount including internal passage means defining a cup drain space and a conduit space, the cup drain space constituting a waste water outlet conduit having an upper terminus in communication with the cup and a lower terminus for coupling to a drain line, the conduit space slidably receiving the potable water and waste water inlet conduits;

threaded means threaded upon the lower extremity of the fastener mount and fixing the faucet housing base in position against the mounting structure.

2. A faucet according to claim 1 wherein the potable and waste water conduits are sufficiently long to permit the upper mount to be raised above the faucet housing for inspection.

3. A faucet according to claim 1 wherein the threaded means comprises a nut having radially extending portions for hand tightening the nut against the mounting structure to fix the fastener mount in position.

4. A faucet according to claim 1 wherein the lower mount is made of plastic, the waste water inlet conduit is made of plastic tubing, and the upper mount includes communicating passageways which accept the tubing and form its upper extremity into a U-shaped portion which defines the discharge end.

5. A faucet according to claim 1 wherein the lower extremity of the fastener mount is unthreaded and is cut away to provide a lateral passage opening into the cup drain space, and including means rotatably mounted to the lower extremity in fluid sealing relationship and operative to carry away waste water from the cup drain space in any selected radial direction.

6. A faucet according to claim 1 wherein the lower extremity of the fastener mount is cut away to provide a lateral passage opening into the conduit space whereby the potable water conduit and waste water inlet conduit can be disposed laterally into the conduit space.

7. A faucet according to claim 1 and including an elongated fastener securing together the upper and lower mounts, and wherein the lower mount is engaged upon the base of the faucet housing to effect the fixing of the base in position against the mounting structure.

8. A faucet according to claim 1 wherein the valve mechanism includes an operating handle, and including indicating means carried by the upper mount and positioned for engagement by the operating handle.

9. A faucet according to claim 1 wherein the fastener mount internal passage means comprises an elongated integral web defining adjacent arcuate cup drain and conduit spaces, and the drain outlet of the cup emptying laterally into the cup drain space, the conduit space being greater in transverse cross section than the cup drain space.

10. A faucet according to claim 9 wherein the web is curvilinear in transverse cross section.

11. A faucet according to claim 1 wherein the potable water and waste water inlet conduits extend from the lower end of the fastener mount.

12. A faucet according to claim 1 wherein the lower mount includes wall means, and the upper mount includes a depending skirt wall overlying at least a portion of the wall means and constraining the upper mount against rotative movement relative to the lower mount.

13. A faucet according to claim 1 wherein the cup is separably carried by the lower mount.

14. A faucet according to claim 1 wherein the valve mechanism is upwardly slidably separable from the upper mount.

15. In a reverse osmosis installation associated with a sink structure having a faucet opening, and in which the installation includes a reverse osmosis faucet connected to a reverse osmosis potable water conduit for dispensing potable water on demand, and further connected to reverse osmosis waste water inlet and outlet conduits for flushing the waste water into a sink drain line, an improved reverse osmosis faucet having an integral air gap between the waste water inlet and outlet conduits and comprising;

a cylindrical faucet housing which includes an upper seat and a base engaged upon the upper side of the sink structure, the base having a central opening aligned with the faucet opening;

a valve mechanism coupled to the potable water conduit and operative to dispense potable water;

an upper mount located within the faucet housing and carried by the upper seat, the upper mount mounting fastening means and receiving the valve mechanism, further receiving the upper extremity of the potable water conduit, and further receiving the upper extremity of the waste water inlet conduit, the upper extremity of the waste water inlet conduit having a downwardly directed end;

a lower mount engaged upon the base and located within the faucet housing below the upper mount, the lower mount being engaged by the fastening means of the upper mount to clamp the upper mount to the lower mount, the lower mount including a waste water collection cup spaced below the discharge end of the waste water inlet conduit and defining an air gap, the cup including a drain outlet, the lower mount further including an elongated, hollow and externally threaded fastener mount extending from the interior of the faucet housing through the central opening, the fastener mount including an integral web dividing the hollow interior of the fastener mount into a cup drain space and a conduit space, the cup drain space defining a waste water outlet conduit having an upper terminus in communication with the cup and a lower terminus coupled to the sink drain line, the conduit space slidably receiving the potable water and waste water inlet conduits and enabling the upper mount to be raised above both the faucet housing and the lower mount for inspection when the fastening means is disengaged; and threaded means threaded upon the lower extremity of the fastener mount and urging the faucet housing base against the sink structure.

16. In a faucet installation associated with a mounting structure having a faucet opening, and in which the installation includes a faucet connected to a potable water conduit for dispensing potable water on demand, and further connected to waste water inlet and outlet conduits, an improved faucet having an integral air gap between the waste water inlet and outlet conduits and comprising;

a faucet housing which includes a base adjacent the upper side of the mounting structure, the base having an opening for alignment with the faucet opening;

a valve mechanism coupled to the potable water conduit and operative to dispense potable water;

mounting means located within the faucet housing and receiving the valve mechanism, and further receiving the upper extremity of the waste water inlet conduit to define with the waste water inlet conduit the upper portion of the air gap, the mounting means including a waste water collection cup defining the lower portion of the air gap, the cup including a drain outlet, the mounting means further including an elongated, hollow and externally threaded fastener mount extending from the interior of the faucet housing and through the central opening, the fastener mount including an internal passage slidably receiving the potable water and waste water inlet conduits and enabling the valve mechanism to be raised above the faucet housing for inspection; and threaded means threaded upon the mounting means and fixing the faucet housing base in position against the mounting structure.

* * * * *